US011200846B2

(12) United States Patent
Liu et al.

(10) Patent No.: US 11,200,846 B2
(45) Date of Patent: Dec. 14, 2021

(54) PIXEL CIRCUIT, SILICON-BASED DISPLAY PANEL, AND DISPLAY DEVICE

(71) Applicant: SEEYA OPTRONICS CO., LTD., Shanghai (CN)

(72) Inventors: Ping-lin Liu, Shanghai (CN); Chang-ho Tseng, Shanghai (CN); Tong Wu, Shanghai (CN)

(73) Assignee: SEEYA OPTRONICS CO., LTD., Shanghai (CN)

( * ) Notice: Subject to any disclaimer, the term of this patent is extended or adjusted under 35 U.S.C. 154(b) by 0 days.

(21) Appl. No.: 17/239,797

(22) Filed: Apr. 26, 2021

(65) Prior Publication Data

US 2021/0335264 A1 Oct. 28, 2021

(30) Foreign Application Priority Data

Apr. 26, 2020 (CN) ..... 202010338999.6

(51) Int. Cl.
*G09G 3/3258* (2016.01)
*G09G 3/3233* (2016.01)

(52) U.S. Cl.
CPC ..... *G09G 3/3258* (2013.01); *G09G 3/3233* (2013.01)

(58) Field of Classification Search
CPC ..... G09G 3/3258; G09G 3/3233
See application file for complete search history.

(56) References Cited

U.S. PATENT DOCUMENTS

2010/0259465 A1 10/2010 Chang
2020/0074936 A1* 3/2020 Chu ..... G09G 3/3266

FOREIGN PATENT DOCUMENTS

| | | | |
|---|---|---|---|
| CN | 101102113 | A | 1/2008 |
| CN | 103093724 | A | 5/2013 |
| CN | 104782048 | A | 7/2015 |
| CN | 105654904 | A | 6/2016 |

* cited by examiner

*Primary Examiner* — Stacy Khoo
(74) *Attorney, Agent, or Firm* — Duane Morris LLP

(57) ABSTRACT

Provided are a pixel circuit, a silicon-based display panel, and a display device. The pixel circuit includes a pixel drive circuit and a pixel compensation circuit; the pixel drive circuit includes a drive transistor and an organic light-emitting element; the drive transistor includes an output terminal and a body terminal, where the output terminal is connected to an anode of the organic light-emitting element, and a cathode of the organic light-emitting element is connected to a cathode signal input terminal and configured to receive a cathode potential inputted from the cathode signal input terminal, the cathode potential being fixed; the body terminal is connected to the pixel compensation circuit at a first node, and a potential of the first node is a body potential; and the cathode potential $V_{com}$, a crossover voltage $V_{oled}$ of the organic light-emitting element, and the body potential $V_{body}$ satisfy that $V_{com}+V_{oled}>V_{body}$.

12 Claims, 8 Drawing Sheets

PIXEL CIRCUIT, SILICON-BASED DISPLAY PANEL, AND DISPLAY DEVICE

CROSS-REFERENCE TO RELATED APPLICATION(S)

This application claims the priority to a Chinese patent application No. CN 202010338999.6 filed at the CNIPA on Apr. 26, 2020, disclosure of which is incorporated herein by reference in its entirety.

TECHNICAL FIELD

The present disclosure relates to the field of display technologies and, in particular, to a pixel circuit, a silicon-based display panel, and a display device.

BACKGROUND

In an existing pixel drive circuit, as a drive current for a load gradually increases, a gain between an output and an input approaches 1. With an increase of the gain, a small signal is amplified to a greater degree. Therefore, a random offset caused by individual differences of different drive circuits is significantly amplified, resulting in poor uniformity and display mura of a display panel.

SUMMARY

In view of this, embodiments of the present disclosure provide a pixel circuit, a silicon-based display panel, and a display device, to solve the technical problem in the related art of poor display uniformity of a display panel due to individual differences of drive circuits.

In a first aspect, the embodiments of the present disclosure provide a pixel circuit. The pixel circuit includes a pixel drive circuit and a pixel compensation circuit.

The pixel drive circuit includes a drive transistor and an organic light-emitting element.

The drive transistor includes an output terminal and a body terminal, where the output terminal is connected to an anode of the organic light-emitting element, and a cathode of the organic light-emitting element is connected to a cathode signal input terminal and configured to receive a cathode potential inputted from the cathode signal input terminal. The cathode potential is fixed.

The body terminal is connected to the pixel compensation circuit at a first node, and a potential of the first node is a body potential.

The cathode potential $V_{com}$, a crossover voltage $V_{oled}$ of the organic light-emitting element, and the body potential $V_{body}$ satisfy that $V_{com}+V_{oled}>V_{body}$.

Optionally, the cathode potential is adjustable.

Optionally, the pixel compensation circuit includes an operational amplifier circuit, a first transistor, a first resistor, and a second resistor. Where the second resistor has adjustable resistance.

The first transistor includes an input terminal connected to a first voltage signal input terminal, an output terminal connected to a first terminal of the second resistor, and a control terminal connected to an output terminal of the operational amplifier circuit, the first resistor includes a first terminal connected to a second terminal of the second resistor and a second terminal connected to a second voltage signal input terminal, and the operational amplifier circuit further includes a forward input terminal connected to a second node and an inverse input terminal connected to the cathode signal input terminal, where the second node is disposed in series between the second resistor and the first resistor.

The first node is disposed in series between the first transistor and the second resistor.

Optionally, the pixel compensation circuit further includes a voltage stabilizing capacitor.

The voltage stabilizing capacitor includes a first terminal connected to the first node and a second terminal grounded.

Optionally, the drive transistor further includes an input terminal and a control terminal.

The input terminal of the first transistor is disposed in a same layer as the input terminal of the drive transistor; the output terminal of the first transistor is disposed in a same layer as the output terminal of the drive transistor; and the control terminal of the first transistor is disposed in a same layer as the control terminal of the drive transistor.

Optionally, the cathode potential $V_{com}$, the crossover voltage $V_{oled}$ of the organic light-emitting element, the body potential $V_{body}$, and a breakdown voltage $V_{breakdown}$ of the drive transistor satisfy that $V_{com}+V_{oled}-V_{body}<V_{breakdown}$.

In a second aspect, the embodiments of the present disclosure further provide a silicon-based display panel. The silicon-based display panel includes a plurality of pixel circuits described in the first aspect of the embodiments of the present disclosure.

The plurality of pixel circuits include a plurality of pixel drive circuits and pixel compensation circuits, and one of the plurality of pixel drive circuits corresponds to a respective one of the plurality of pixel circuits and one of the pixel compensation circuits corresponds to one or more pixel circuits.

Optionally, the silicon-based display panel further includes a silicon substrate and an N-type potential well layer disposed on one side of the silicon substrate, where the N-type potential well layer includes a first surface facing towards the side of the silicon substrate and a second surface facing away from the side of the silicon substrate, the first surface has a first ion doping concentration N1, and the second surface has a second ion doping concentration N2, and $|N1-N2|/N1\leq 10\%$.

The plurality of pixel drive circuits are disposed in the N-type potential well layer.

Optionally, the plurality of pixel drive circuits are arranged in an array.

The silicon-based display panel includes a plurality of pixel compensation circuits arranged in an array, where each of the plurality of pixel compensation circuits corresponds to a respective one of the plurality of pixel drive circuits; or the silicon-based display panel includes a plurality of pixel compensation circuits arranged in a same column, where pixel drive circuits in a same row correspond to a same pixel compensation circuit; or the silicon-based display panel includes a plurality of pixel compensation circuits arranged in a same row, where pixel drive circuits in a same column correspond to a same pixel compensation circuit; or the silicon-based display panel includes one pixel compensation circuit, where the plurality of pixel drive circuits arranged in the array correspond to the one pixel compensation circuit.

Optionally, the silicon-based display panel further includes a display region and a non-display region surrounding the display region.

The plurality of pixel drive circuits are disposed in the display region.

When each of the plurality of pixel compensation circuits corresponds to a respective one of the plurality of pixel drive circuits, the plurality of pixel compensation circuits are disposed in the display region.

When the pixel drive circuits in the same row correspond to the same pixel compensation circuit, the pixel drive circuits in the same column correspond to the same pixel compensation circuit, or the plurality of pixel drive circuits arranged in the array correspond to the one pixel compensation circuit, the at least one pixel compensation circuit is disposed in the non-display region.

In a third aspect, the embodiments of the present disclosure further provide a display device. The display device includes the silicon-based display panel described in the second aspect of the embodiments of the present disclosure.

In the pixel circuit, the silicon-based display panel, and the display device provided by the embodiments of the present disclosure, the pixel circuit includes the pixel drive circuit and the pixel compensation circuit, where the output terminal of the drive transistor is connected to the anode of the organic light-emitting element, the cathode of the organic light-emitting element receives the fixed cathode potential, and the body terminal of the drive transistor is connected to the pixel compensation circuit at the first node. The potential of the first node is reasonably set, so as to ensure that a sum of the cathode potential and the crossover voltage of the organic light-emitting element, that is, the voltage of the output terminal of the drive transistor, is greater than the body potential. This is different from the solution in the related art in which the voltage of the output terminal is the same as the body potential and ensures that the source-substrate voltage potential of the drive transistor can be increased so that the voltage corresponding to the body effect of the drive transistor is increased, the threshold voltage of the drive transistor is increased, the proportion of the random offset caused by the individual differences of drive circuits in the threshold voltage is decreased, the effect of the random offset on a drive current is reduced, and the uniformity of a display effect is improved.

BRIEF DESCRIPTION OF DRAWINGS

Other features, objects, and advantages of the present disclosure will become more apparent from a detailed description of non-restrictive embodiments with reference to the drawings described below.

DETAILED DESCRIPTION

To make the objects, technical solutions, and advantages of the present disclosure clearer, the technical solutions of the present disclosure will be described completely below in conjunction with the drawings in the embodiments of the present disclosure and specific implementations. Apparently, the embodiments described herein are part, not all, of the embodiments of the present disclosure. Based on the embodiments of the present disclosure, all other embodiments obtained by those of ordinary skill in the art on the premise that no creative work is done are within the scope of the present disclosure.

Before a detailed description of the solutions in the embodiments of the present disclosure, the principles of the embodiments of the present disclosure are described.

Figure 1:
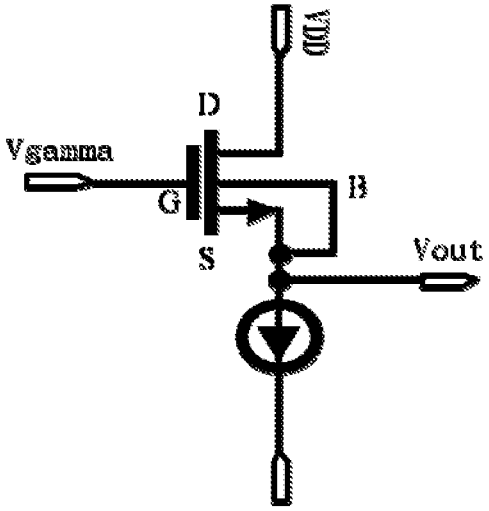
FIG. 1 shows a structure diagram of a pixel drive circuit in the related art.
Figure 2:
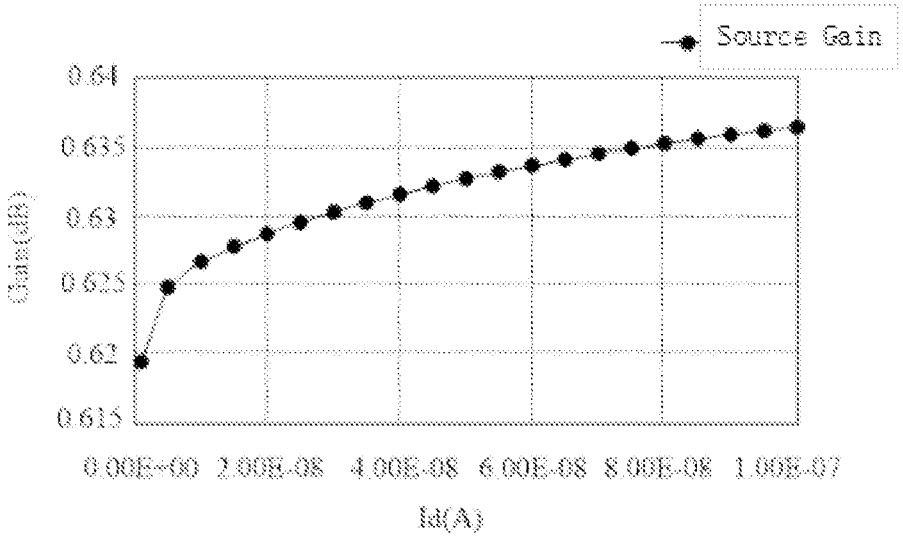
FIG. 2 is a diagram showing a correspondence between a gain and a drive current of a pixel drive circuit.
Figure 3:
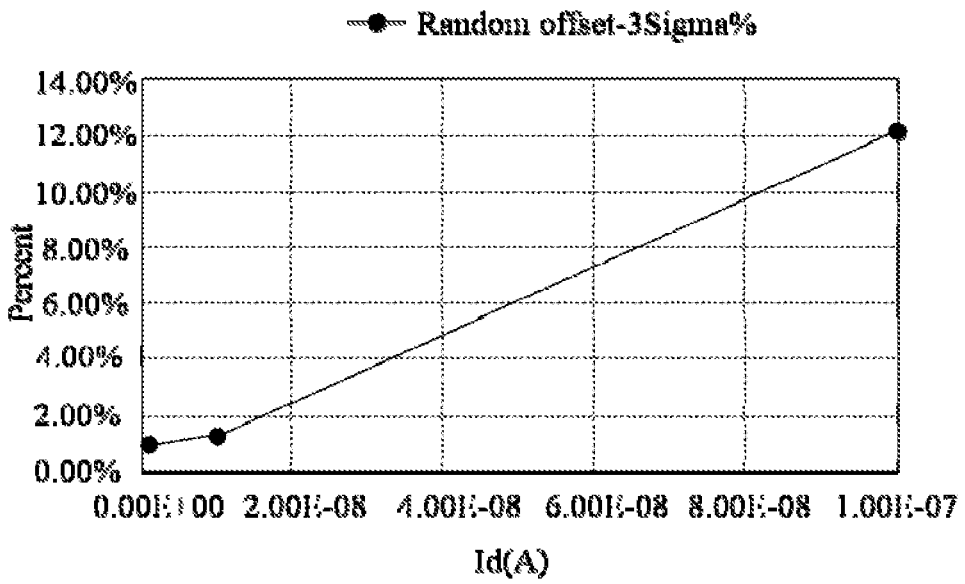
FIG. 3 is a diagram showing a correspondence between a current change due to a random offset and a drive current of a pixel drive circuit.

FIG. 1 shows a structure diagram of a pixel drive circuit in the related art. FIG. 2 is a diagram showing a correspondence between a gain and a drive current of a pixel drive circuit. FIG. 3 is a diagram showing a correspondence between a current change due to a random offset and a drive current of a pixel drive circuit. As shown in FIG. 1, in the related art, a source follower circuit is applied to the pixel drive circuit as a voltage buffer, and a signal is received through a gate (G) for a source (S) to drive a load (an organic light-emitting element). Source potential energy "follows" a gate voltage, thereby providing a stable drive voltage for the load.

Figure 6:
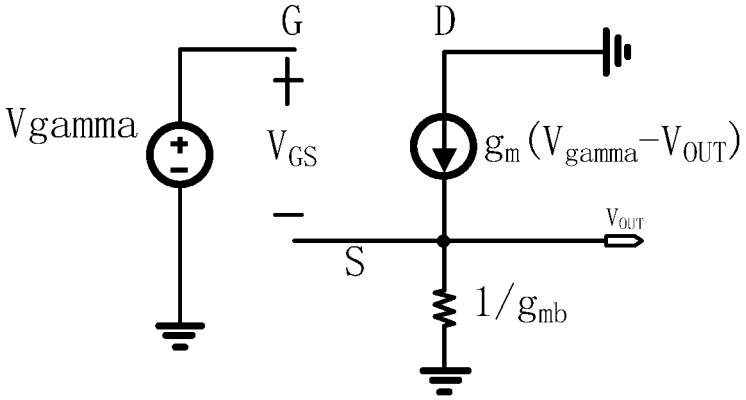
FIG. 6 is a diagram showing an equivalent small signal film of a pixel drive circuit according to embodiments of the present disclosure.

In the pixel drive circuit shown in FIG. 1, a gain $A_V$, channel transconductance $g_m$, and a threshold voltage $V_{TH}$ of the pixel drive circuit are expressed by the following formulas:

$$A_V = \frac{\partial V_{OUT}}{\partial V_{IN}} = \frac{g_m}{g_m + g_{mb}} \tag{1}$$

$$g_m = \frac{I_D}{V_{GS} - V_{TH}} = \mu C_{OX} \frac{W}{L}(V_{GS} - V_{TH}) \tag{2}$$

$$V_{TH} = V_{TH0} \pm \Delta V + \gamma\left(\sqrt{2\phi_F + |V_{SB}|} - \sqrt{2\phi_F}\right) \tag{3}$$

where $g_m$ denotes the channel transconductance, $g_{mb}$ denotes the transconductance of a body effect (as shown in FIG. 6, an equivalent small signal model of a pixel circuit), $I_D$ denotes a drive current, $V_{GS}$ denotes a gate-source voltage difference of a drive transistor, $V_{TH}$ denotes the threshold voltage, μ denotes the carrier mobility of the pixel drive circuit, $C_{OX}$ denotes the capacitance of a gate oxide layer in a unit area of the pixel drive circuit, W and L denote a channel width and a channel length of the pixel drive circuit, respectively, $V_{THO}$ denotes an intrinsic threshold voltage, ΔV denotes the random offset of the pixel drive circuit, which exists in the threshold voltage, γ denotes a coefficient of the body effect, and $\varphi_F$ denotes a flat-band barrier. $\varphi_F=(\kappa T/q)\ln(N_{sub}/n_i)$, where K denotes a Boltzmann constant, T denotes an absolute temperature, q denotes electron charges, $N_{sub}$ denotes a substrate concentration, $n_i$ denotes an intrinsic doping concentration, and $|V_{SB}|$ denotes a source-substrate voltage potential.

As can be seen from formulas (1) and (2), as the drive current $I_D$ gradually increases, $g_m$ is multiplied, and when $g_m$ approaches infinity, the gain approaches 1, as shown in FIG. 2. The larger the gain, the stronger the capability to amplify a small signal. Therefore, the random offset generated at an input terminal and caused by individual differences of pixel drive circuits is significantly amplified with an increase of $g_m$, that is, the random offset of the pixel drive circuit has a greater effect. As shown in FIG. 3, the larger the current, the greater the random offset of the pixel drive circuit.

To conclude, in the pixel drive circuit using the source follower circuit, the larger gain the pixel drive circuit has, the greater effect the random error has; moreover, the random offset is irrelevant to a frequency and has a relatively great effect within any frequency range. A pixel circuit operating within a low-frequency range is also affected. Therefore, the random offset of the pixel drive circuit is one of main reasons for poor display uniformity.

In a silicon-based organic light-emitting display apparatus, the effect of the random offset can be reduced by decreasing the current. However, the display apparatus cannot only operate at low gray scales, and the current display apparatus has increasingly high requirements on brightness. Thus, the applications of conventional voltage drive circuits are greatly limited.

To solve the above-mentioned technical problem, the inventive concept of the embodiments of the present disclosure is proposed, in which the effect of the random offset on pixel display is effectively reduced without decreasing the drive current. The inventive concept of the embodiments of the present disclosure is described in detail below.

As the drive current is decreased, the gain is reduced, so that the random offset ΔV is amplified less greatly, thereby reducing the effect of the random offset. Then, an input voltage is appropriately increased according to a correspondence between an input and an output to compensate for the drive current.

Specifically, as can be seen from formula (3), the threshold voltage of the pixel drive circuit is relevant to the intrinsic threshold voltage, the random offset due to the input, and the body effect of the pixel drive circuit, and the random offset due to the input is directly embodied in the threshold voltage of the pixel drive circuit. To reduce the effect of ΔV on $V_{TH}$, the body effect of the pixel drive circuit can be artificially increased, thereby reducing the effect of the random offset due to the input on the threshold voltage.

Further, the drive current of the organic light-emitting element and the input and the output of the pixel drive circuit satisfy the following requirements:

$$I_D = \beta\frac{W}{L}(V_{GS} - V_{TH})^2 \tag{4}$$

$$I_D = \beta\frac{W}{L}\left(V_{GS} - V_{TH0} \pm \Delta V - \gamma\left(\sqrt{2\phi_F + |V_{SB}|} - \sqrt{2\phi_F}\right)\right)^2 \tag{5}$$

$$V_{OUT} = A_V * V_{IN} = \frac{g_m}{g_m + g_{mb}}(\pm\Delta V + V_{gamma}) \tag{6}$$

Figure 4:
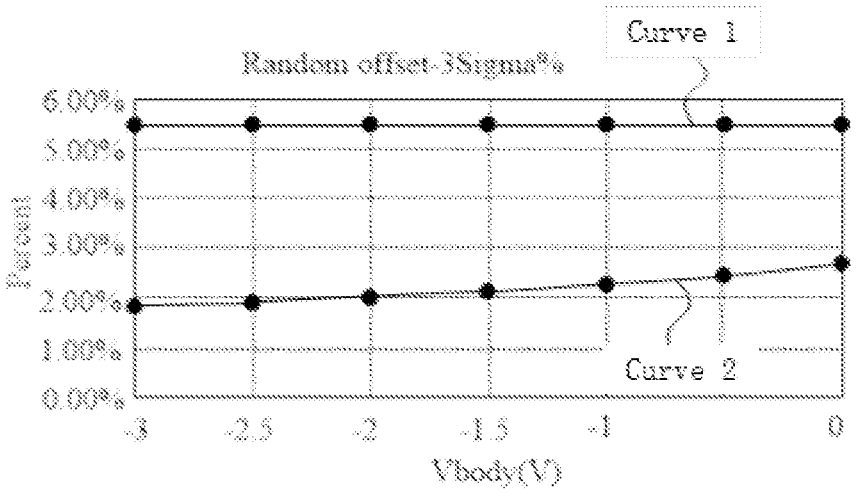
FIG. 4 is a diagram showing a correspondence between a current change due to a random offset and a body potential of a pixel drive circuit.
Figure 5:
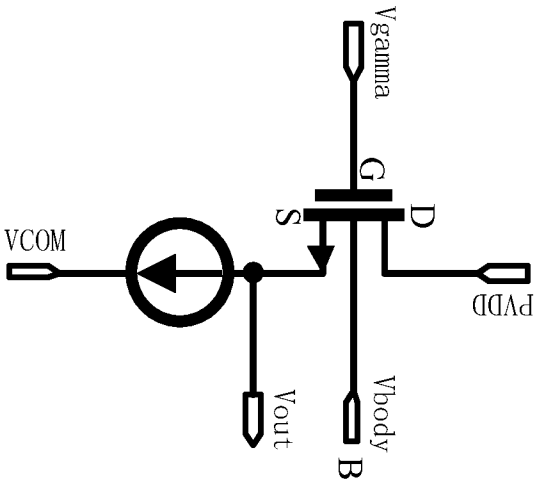
FIG. 5 shows a structure diagram of a pixel drive circuit according to embodiments of the present disclosure.

The drive current of the organic light-emitting element is expressed by formula (4). Formula (5) is obtained with formula (3) being substituted into formula (4). It can be seen from formula (5) that as the body effect increases, a squared term in the drive current decreases correspondingly and that the drive current V decreases by a squared multiple with an increase of $|V_{SB}|$. Therefore, $|V_{SB}|$ provides negative feedback for the drive current, that is, with an increase of $|V_{SB}|$, the drive current decreases, the gain decreases, and the effect of the random offset is reduced. FIG. 4 is a diagram showing a correspondence between a current change due to a random offset and a body potential of a pixel drive circuit. FIG. 5 shows a structure diagram of a pixel drive circuit according to embodiments of the present disclosure. FIG. 4 shows the effect of the body effect on the random offset, where curve 1 shows the effect of the random offset in the conventional pixel drive circuit and curve 2 shows the effect of the random offset in the pixel circuit with new architecture shown in FIG. 5. As can be seen from FIG. 4, the effect of the random offset on the current of the conventional pixel drive circuit exceeds 5%. To prevent gray scale transition, the lowest requirement in optical display is a current difference not higher than 2.5%. Therefore, the conventional pixel drive circuit cannot satisfy this requirement, resulting in serious display mura. In the pixel drive circuit shown in FIG. 5, a body potential and a source voltage in the pixel drive circuit are configured to be different and $|V_{SB}|$ is continuously increased, so as to ensure that the body effect continuously increases and $V_{TH}$ is reduced so that the random offset has an increasingly small effect on the current. As can be seen from curve 2 in FIG. 4, the effect on the current is not higher than 2.5%, which perfectly satisfies the optical requirement.

Further, the current decreases with an increase of the body effect and formula (1) is rewritten as formula (6). Since $g_n$ decreases with an increase of the body effect, the coefficient term $$\frac{g_m}{g_m + g_{mb}} < 1$$

and ΔV is infinitely weakened, further verifying that the random offset is suppressed. Meanwhile, the input voltage $V_{gamma}$ is also weakened with $$\frac{g_m}{g_m + g_{mb}}.$$

To ensure that the display apparatus is still applied within a high-brightness range, the input voltage may be increased, and the written voltage $V_{IN}$ may be configured to be $$\left(1 + \frac{g_{mb}}{g_m}\right)V_{gamma}.$$

Thus, formula (6) is rewritten as formula (7):

$$V_{OUT} = A_V * V_{IN} = \frac{g_m}{g_m + g_{mb}}\left(\pm\Delta V + \left(1 + \frac{g_{mb}}{g_m}\right)V_{gamma}\right) = \pm\frac{g_m}{g_m + g_{mb}}\Delta V + V_{gamma} \approx V_{gamma} \tag{7}$$

As can be seen from formula (7), the pixel drive circuit shown in FIG. 5 copies the input voltage to the output, that is, the voltage for driving the organic light-emitting element is stable and controllable.

Therefore, the pixel drive circuit shown in FIG. 5, provided by the embodiments of the present disclosure, effectively reduces the effect of the random offset on the display while ensuring constant brightness, significantly alleviating the display mura and ensuring good display uniformity.

The basic inventive concept of the embodiments of the present disclosure is described in detail above. Based on the basic inventive concept described above, the technical solutions of the embodiments of the present disclosure are described in detail below.

Figure 7:
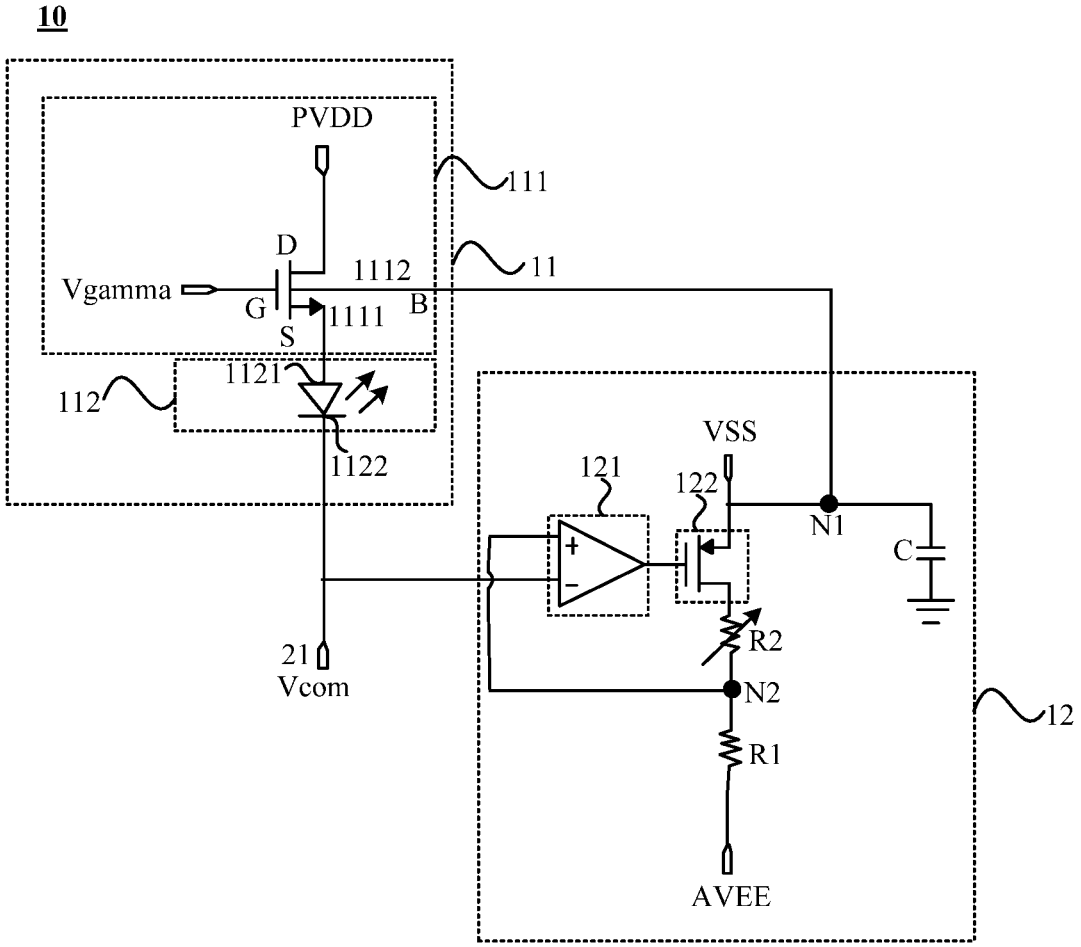
FIG. 7 shows a structure diagram of a pixel circuit according to embodiments of the present disclosure.

FIG. 7 shows a structure diagram of a pixel circuit according to embodiments of the present disclosure. As shown in FIG. 7, the pixel circuit 10 according to the embodiments of the present disclosure includes a pixel drive circuit 11 and a pixel compensation circuit 12; where the pixel drive circuit 11 includes a drive transistor 111 and an organic light-emitting element 112; the drive transistor 111 includes an output terminal 1111 and a body terminal 1112, where the output terminal 1111 is connected to an anode 1121 of the organic light-emitting element 112, and a cathode 1122 of the organic light-emitting element 112 is connected to a cathode signal input terminal 21 and configured to receive a cathode potential inputted from the cathode signal input terminal 21. The cathode potential is fixed; the body terminal 1112 is connected to the pixel compensation circuit 12 at a first node N1, and a potential of the first node N1 is a body potential; and the cathode potential $V_{com}$, a crossover voltage $V_{oled}$ of the organic light-emitting element, and the body potential $V_{body}$ satisfy that $V_{com}+V_{oled}>V_{body}$.

Exemplarily, as shown in FIG. 7, the embodiments of the present disclosure provide the pixel circuit 10 including the pixel drive circuit 11 and the pixel compensation circuit 12, where the pixel drive circuit 11 further includes the drive transistor 111 and the organic light-emitting element 112, the drive transistor 111 may be a metal-oxide-semiconductor field-effect transistor (MOSFET), and the output terminal 1111 (that is, a source terminal) and the body terminal 1112 of the drive transistor 111 are provided with different voltages, respectively. In this manner, the source-substrate voltage potential of the drive transistor 111 is not equal to 0 so that the voltage corresponding to the body effect of the drive transistor 111 can be increased, the threshold voltage of the drive transistor 111 is further increased, the proportion of the voltage corresponding to the body effect in the threshold voltage of the drive transistor 111 is increased, the proportion of the voltage corresponding to the random offset of the drive transistor 111 in the threshold voltage of the drive transistor 111 is decreased, the gain of the drive transistor 111 is decreased, the effect of the random offset on the display mura is reduced, and the display uniformity is improved.

Specifically, the output terminal 1111 (that is, the source terminal) and the body terminal 1112 are provided with different voltages, respectively, which may be set in a manner described below. The output terminal 1111 is connected to the anode 1121 of the organic light-emitting element 112, and the cathode 1122 of the organic light-emitting element 112 is connected to the cathode signal input terminal 21 and configured to receive a fixed voltage signal Vann inputted from the cathode signal input terminal 21. Considering the crossover voltage $V_{oled}$ of the organic light-emitting element, it is known that the voltage of the output terminal 1111 (that is, the source terminal) is $V_{com}+V_{oled}$. Further, the body terminal 1112 is connected to the pixel compensation circuit 12 at the first node N1, the potential of the first node N1 is the body potential $V_{body}$, and the cathode potential Vann, the crossover voltage $V_{oled}$ of the organic light-emitting element and the body potential $V_{body}$ are configured to satisfy that $V_{com}+V_{oled}>V_{body}$. On the one hand, it is ensured that the source voltage and the body potential of the drive transistor 111 are different and the voltage corresponding to the body effect of the drive transistor 111 can be increased. On the other hand, it is ensured that the body potential $V_{body}$ is not too high, avoiding the problem in which a backflow current is formed between the body terminal and the source terminal since the body potential is higher than the source voltage, resulting in an uncontrollable drive current of the organic light-emitting element 112.

To conclude, the pixel circuit provided by the embodiments of the present disclosure includes the pixel drive circuit and the pixel compensation circuit, where the output terminal of the pixel drive circuit is connected to the cathode signal input terminal through the organic light-emitting element to receive the fixed cathode potential inputted from the cathode signal input terminal, and the body terminal is connected to the pixel compensation circuit at the first node. The potential of the first node is reasonably set, so as to ensure that a sum of the cathode potential and the crossover voltage of the organic light-emitting element, that is, the voltage of the output terminal of the drive transistor, is greater than the body potential. This is different from the solution in the related art in which the voltage of the output terminal is the same as the body potential and ensures that the source-substrate voltage potential of the drive transistor can be increased so that the voltage corresponding to the body effect of the drive transistor is increased, the threshold voltage of the drive transistor is increased, the proportion of the random offset caused by the individual differences of drive circuits in the threshold voltage is decreased, the effect of the random offset on the drive current is reduced, and the uniformity of a display effect is improved.

Based on the preceding embodiments, the cathode potential Vann is adjustable.

Exemplarily, the entire silicon-based display panel includes a plurality of pixel drive circuits 11. To ensure that the pixel circuit 10 provided by the embodiments of the present disclosure is applicable to various pixel drive circuits 11 with different random offsets, the cathode potential \icon, may be configured to be adjustable, that is, the cathode potential \icon, received by the cathode 1122 of the organic light-emitting element 112 is configured to be adjustable. That is, the source voltage of the drive transistor 111 is adjustable. Thus, for the pixel drive circuits 11 with different random offsets, the body effects of different pixel drive circuits 11 are different and the threshold voltages of the drive transistors 111 are decreased to different degrees, ensuring the display uniformity of the entire silicon-based display panel and avoiding the display mura.

Further, in the case where the cathode potential \icon, is adjustable, the body potential is also adjustable within a small range, that is, the voltage at the node (the first node N1) at which the body terminal 1112 of the drive transistor 111 is connected to the pixel compensation circuit 12 is adjustable, so as to ensure that the compensation voltage provided by the pixel compensation circuit 12 is applicable to the various pixel drive circuits 11 in the entire silicon-based display panel, ensure the display uniformity of the entire silicon-based display panel, and avoid the display mura.

How to implement the adjustable body potential $V_{body}$ through the adjustable cathode potential $V_{com}$ is described in detail below.

Specifically, with continued reference to FIG. 7, the pixel compensation circuit 12 includes an operational amplifier circuit 121, a first transistor 122, a first resistor R1, and a second resistor R2. The second resistor R2 has adjustable resistance, the first transistor 122 has an input terminal connected to a first voltage signal input terminal, an output terminal connected to a first terminal of the second resistor R2, and a control terminal connected to an output terminal of the operational amplifier circuit 121. The first resistor R1 has a first terminal connected to a second terminal of the second resistor R2 and a second terminal connected to a second voltage signal input terminal, and the operational amplifier circuit 121 further has a forward input terminal connected to a second node N2 and an inverse input terminal connected to the cathode signal input terminal 21. Where the second node N2 is disposed in series between the second resistor R2 and the first resistor R1, and the first node N1 is disposed in series between the first transistor 122 and the second resistor R2.

Exemplarily, as shown in FIG. 7, in the embodiments of the present disclosure, the pixel compensation circuit 12 includes the second resistor R2, the first node N1 is disposed in series between the second resistor R2 and the first transistor 122, and the second resistor R2 has adjustable resistance so that it is ensured that the potential of the first node N1 is adjustable, that is, the body potential $V_{body}$ is adjustable. Further, the inverse input terminal of the operational amplifier circuit 121 is connected to the cathode signal input terminal 21 so that $V_{com}$ is used as a reference voltage for the voltage $V_{body}$ to be generated between a voltage VSS at the first voltage signal input terminal and a voltage AVEE at the second voltage signal input terminal, such that a voltage difference is generated between $V_{body}$ and $V_{com}$. That is, the source-substrate voltage potential of each drive transistor is increased, the voltage corresponding to the body effect of the drive transistor is increased, the threshold voltage of the drive transistor is increased, the proportion of the random offset caused by the individual differences of drive circuits in the threshold voltage is decreased, the effect of the random offset on the drive current is reduced, and the uniformity of the display effect is improved.

As shown in formula (8), the cathode potential $V_{com}$ is adjustable and the resistance of the variable resistor R2 may be further adjusted so that the magnitude of the body potential $V_{body}$ can be changed, thereby selecting an appropriate value of ($V_{com}$–$V_{body}$).

$$Vbody = Vcom + \frac{Vcom - AVEE}{R1} * R2 = -\frac{R2}{R1} * AVEE + \left(1 + \frac{R2}{R1}\right) \quad (8)$$

If $$AVEE = 0\ V,\quad Vbody = \left(1 + \frac{R2}{R1}\right) * Vcom.$$

The magnitude of $V_{body}$ may be changed by adjusting the resistance of the variable resistor R2, so as to select the appropriate value of ($V_{com}$–$V_{body}$). After $V_{com}$ is determined, the voltage Vsource may be determined and $V_{body}$ changes with $V_{com}$ so that the corresponding source-substrate voltage of each drive transistor is fixed, and the decreased threshold voltage of the drive transistor 111 can be obtained, thereby suppressing the random offset. Then, the input voltage Vgamma of the drive transistor 111 is changed for brightness adjustment, thereby achieving high-brightness display.

To conclude, according to the technical solutions provided by the embodiments of the present disclosure, the cathode potential $V_{com}$ is configured to be adjustable. For the pixel drive circuits 11 with different random offsets, the body effects of the different pixel drive circuits 11 are different and the threshold voltages of the drive transistors 111 are decreased to different degrees, ensuring the display uniformity of the entire silicon-based display panel. Further, it is set that the pixel compensation circuit includes the operational amplifier circuit 121, the first transistor 122, the first resistor R1, and the second resistor R2, the second resistor R2 has adjustable resistance, and the inverse input terminal of the operational amplifier circuit 121 is connected to the cathode signal input terminal 21, so that it is ensured that the pixel compensation circuit can select an appropriate value of ($V_{com}$–$V_{body}$) by simply adjusting the resistance of the second resistor R2 instead of adjusting $V_{com}$ and $V_{body}$ separately. The compensation manner is simple. Meanwhile, the appropriate value of ($V_{com}$–$V_{body}$) is selected so that the voltage corresponding to the body effect can be appropriately increased and the effect of the random offset of the drive transistor is appropriately reduced. Therefore, the technical solutions provided by the embodiments of the present disclosure can be better applied to a display apparatus with the requirements for high brightness and high uniformity.

Based on the preceding embodiments, the pixel compensation circuit 12 may further include a voltage stabilizing capacitor C; where the voltage stabilizing capacitor C has a first terminal connected to the first node N1 and a second terminal grounded. The voltage stabilizing capacitor C is disposed, so as to ensure that the cathode potential $V_{com}$ at the first node N1 is stable, the voltage ($V_{com}$–$V_{body}$) is stable, and the voltage corresponding to the body effect is stable, thereby ensuring the stable compensation effect for the pixel drive circuit 11 and the good and stable effect of improving the display mura.

Optionally, the drive transistor 111 may further include an input terminal and a control terminal; where the input terminal of the first transistor 122 is disposed in a same layer as the input terminal of the drive transistor 111 (not shown in the figure); the output terminal of the first transistor 122 is disposed in a same layer as the output terminal of the drive transistor 111; and the control terminal of the first transistor 122 is disposed in a same layer as the control terminal of the drive transistor 111.

Exemplarily, the input terminal of the first transistor 122 is disposed in the same layer as the input terminal of the drive transistor 111, so as to ensure that the input terminal of the first transistor 122 and the input terminal of the drive transistor 111 can be manufactured in the same process, thereby ensuring that the pixel circuit is manufactured by a simple process on the basis that the pixel circuit is ensured to have a simple film structure. Similarly, the output terminal of the first transistor 122 is disposed in the same layer as the output terminal of the drive transistor 111, so as to ensure that the output terminal of the first transistor 122 and the output terminal of the drive transistor 111 can be manufactured in the same process, thereby ensuring that the pixel circuit is manufactured by a simple process on the basis that the pixel circuit is ensured to have a simple film structure.

Similarly, the control terminal of the first transistor 122 is disposed in the same layer as the control terminal of the drive transistor 111, so as to ensure that the control terminal of the first transistor 122 and the control terminal of the drive transistor 111 can be manufactured in the same process, thereby ensuring that the pixel circuit is manufactured by a simple process on the basis that the pixel circuit is ensured to have a simple film structure.

Optionally, the cathode potential $V_{com}$, the crossover voltage $V_{oled}$ of the organic light-emitting element, the body potential $V_{body}$, and a breakdown voltage $V_{breakdown}$ of the drive transistor may also satisfy that $V_{com}+V_{oled}-V_{body}<V_{breakdown}$, so as to avoid that too low a body potential $V_{body}$ causes the drive transistor 111 to be broken down since $V_{BD}$ exceeds an extreme voltage and the display is abnormal. Therefore, it is set that $V_{com}+V_{oled}-V_{body}<V_{breakdown}$ to ensure that a voltage difference between the source and body terminals of the drive transistor is lower than the breakdown voltage of the drive transistor, the drive transistor operates normally, the pixel circuit operates normally, and the silicon-based display panel can perform normal display.

Based on the same inventive concept, the embodiments of the present disclosure further provide a silicon-based display panel including a plurality of pixel circuits described in the preceding embodiments of the present disclosure. The plurality of pixel circuits include a plurality of pixel drive circuits and at least one pixel compensation circuit, and each of the plurality of pixel drive circuits corresponds to a respective one of the plurality of pixel circuits.

Exemplarily, in the silicon-based display panel provided by the embodiments of the present disclosure, the plurality of pixel circuits may share the same pixel compensation circuit, thereby ensuring a simple circuit arrangement. Alternatively, each pixel circuit may correspond to one pixel compensation circuit, ensuring that each pixel circuit is independently adjusted without affecting other pixel circuits. Alternatively, part of the plurality of pixel circuits may share the same pixel compensation circuit, ensuring both the simple circuit arrangement and independent adjustment.

A plurality of arrangements are described below.

Optionally, the plurality of pixel drive circuits 11 are arranged in an array; the silicon-based display panel 100 includes a plurality of pixel compensation circuits 12 arranged in an array, where each of the plurality of pixel compensation circuits 12 corresponds to a respective one of the plurality of pixel drive circuits 11; or the silicon-based display panel 100 includes a plurality of pixel compensation circuits 12 arranged in a same column, where pixel drive circuits 11 in a same row correspond to a same pixel compensation circuit 12; or the silicon-based display panel 100 includes a plurality of pixel compensation circuits 12 arranged in a same row, where pixel drive circuits 11 in a same column correspond to a same pixel compensation circuit 12; or the silicon-based display panel 100 includes one pixel compensation circuit 12, where the plurality of pixel drive circuits 11 arranged in the array correspond to the one pixel compensation circuit 12.

Figure 8:
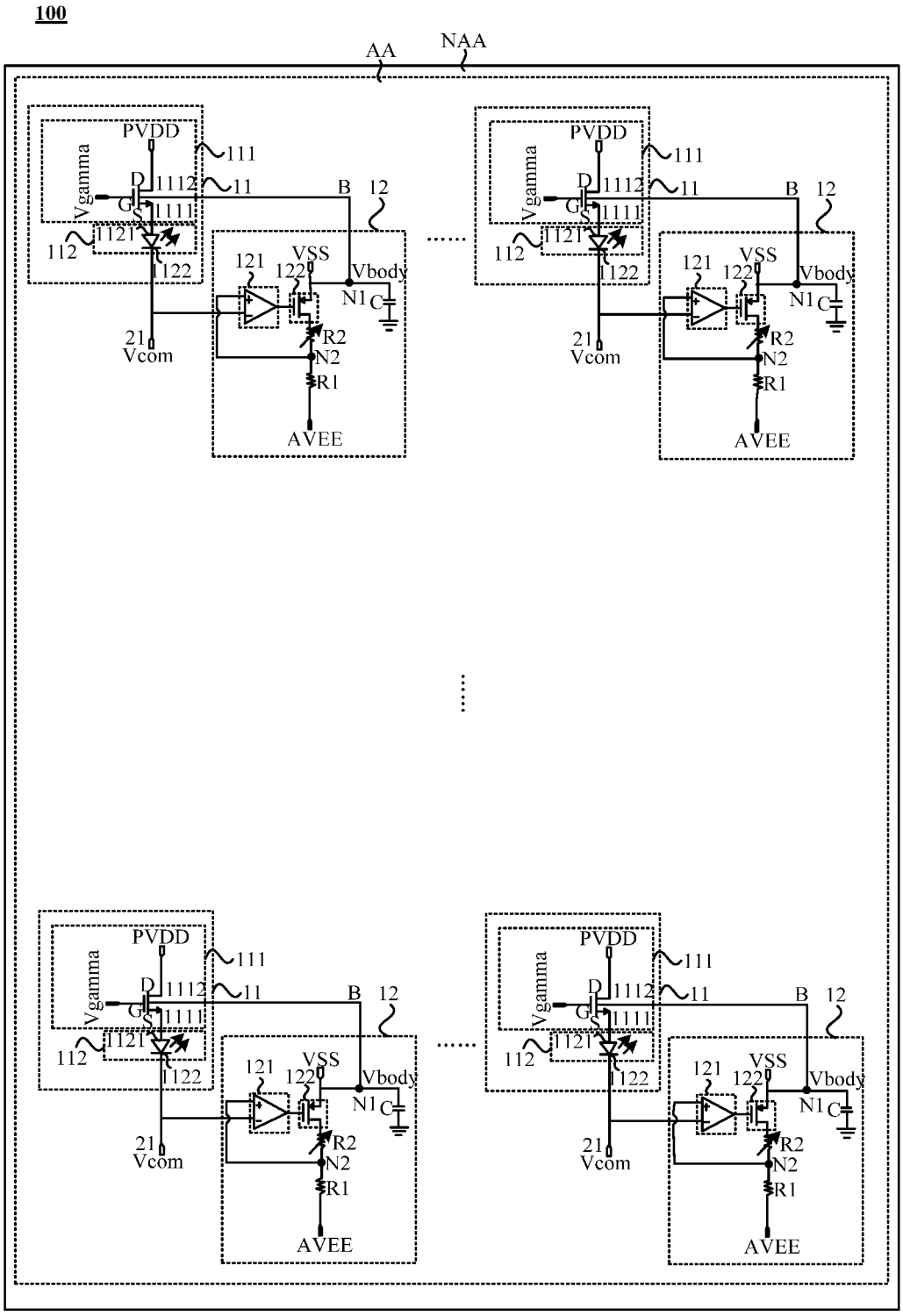
FIG. 8 shows a structure diagram of a silicon-based display panel according to embodiments of the present disclosure.
Figure 9:
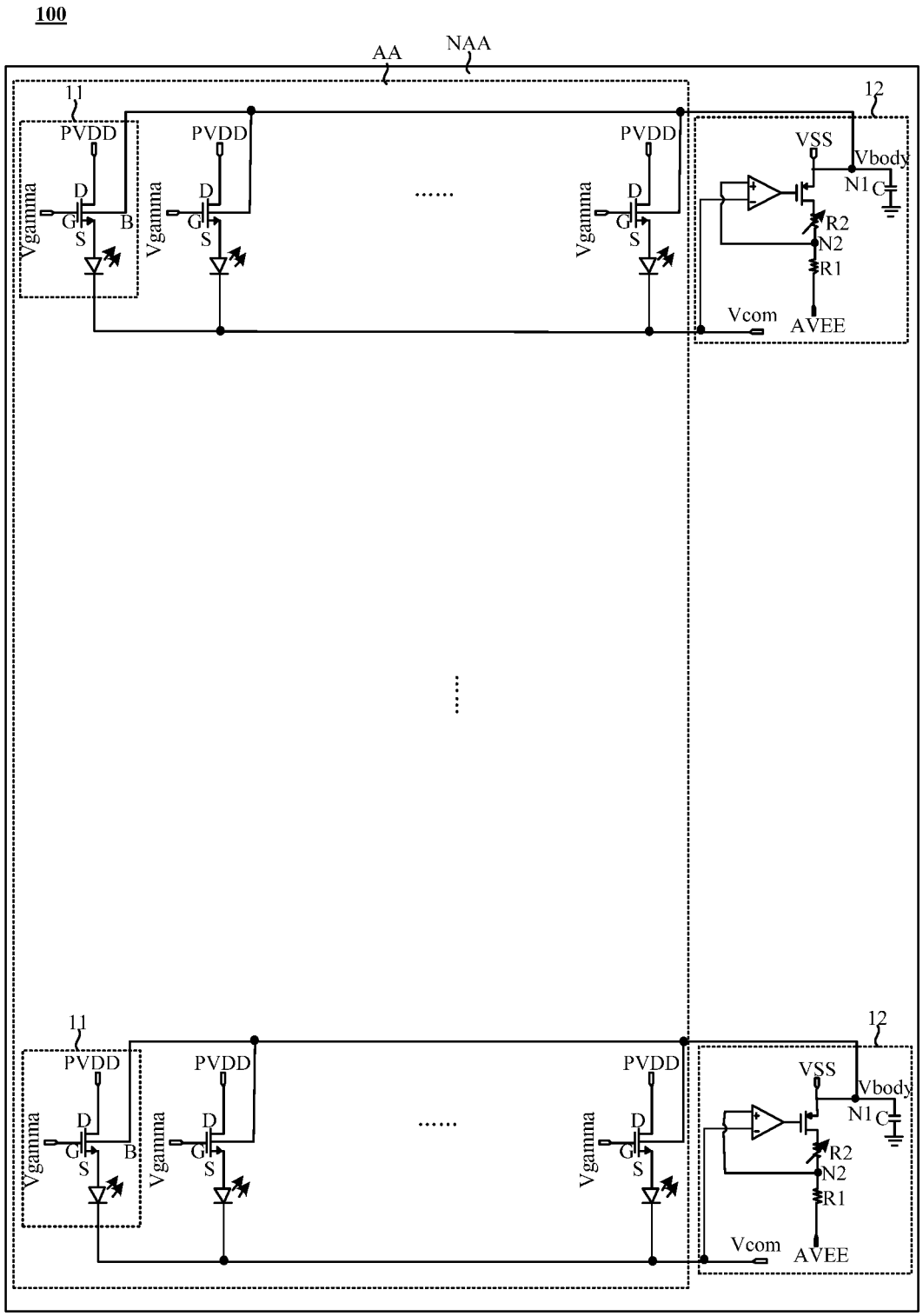
FIG. 9 shows a structure diagram of another silicon-based display panel according to embodiments of the present disclosure.
Figure 10:
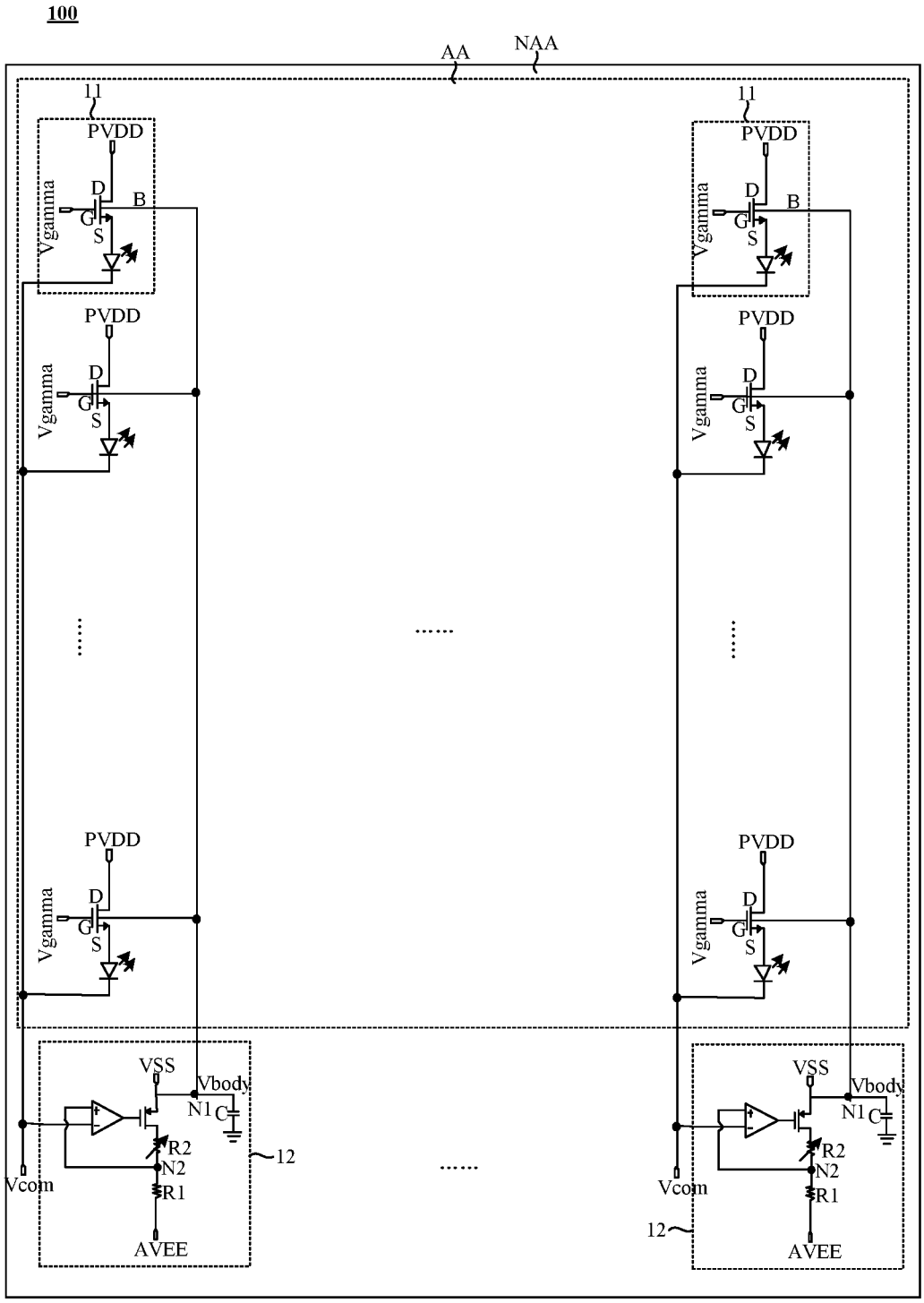
FIG. 10 shows a structure diagram of another silicon-based display panel according to embodiments of the present disclosure.
Figure 11:
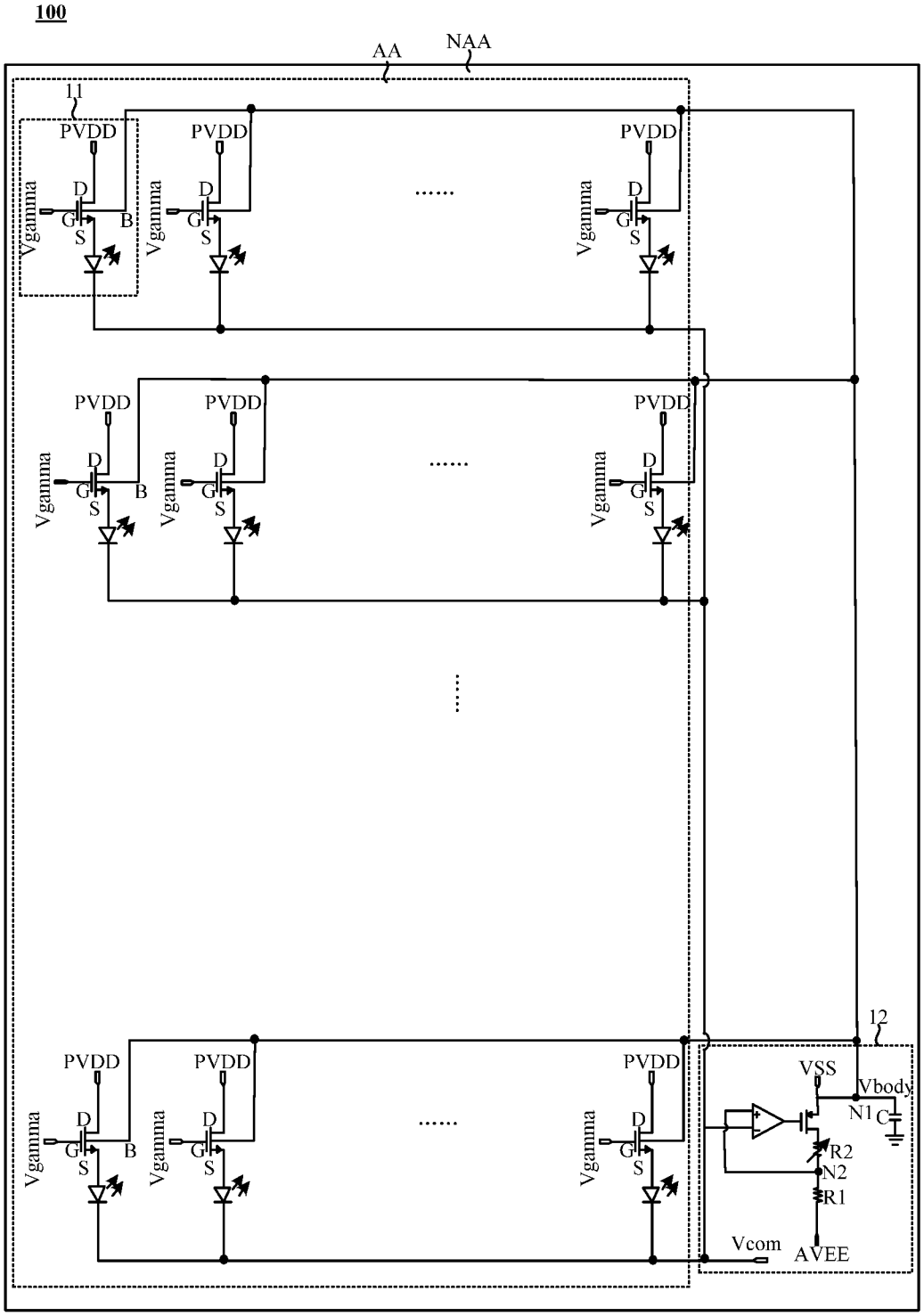
FIG. 11 shows a structure diagram of another silicon-based display panel according to embodiments of the present disclosure.

Specifically, FIG. 8 is a structure diagram of a silicon-based display panel according to the embodiments of the present disclosure. FIG. 8 illustrates an example in which each pixel compensation circuit 12 correspond to a respective one pixel drive circuit 11. FIG. 9 is a structure diagram of another silicon-based display panel according to the embodiments of the present disclosure. FIG. 9 illustrates an example in which the pixel drive circuits 11 in the same row correspond to the same pixel compensation circuit 12. FIG. 10 is a structure diagram of another silicon-based display panel according to the embodiments of the present disclosure. FIG. 10 illustrates an example in which the pixel drive circuits 11 in the same column correspond to the same pixel compensation circuit 12. FIG. 11 is a structure diagram of another silicon-based display panel according to the embodiments of the present disclosure. FIG. 11 illustrates an example in which the plurality of pixel drive circuits 11 arranged in the array correspond to the same pixel compensation circuit 12.

As shown in FIG. 8, the silicon-based display panel 100 includes the plurality of pixel compensation circuits 12 arranged in the array, and each pixel compensation circuit 12 corresponds to its respective one pixel drive circuit 11 and configured to provide a body potential $V_{body}$ for the pixel drive circuit 11 electrically connected to the pixel compensation circuit 12, thereby ensuring the high positioning accuracy of the body potential $V_{body}$ and the accurate compensation for the random offset of each drive transistor. As shown in FIG. 9, the silicon-based display panel 100 includes the plurality of pixel compensation circuits 12 arranged in the same column, and the pixel drive circuits 11 in the same row correspond to the same pixel compensation circuit 12. In this manner, each pixel compensation circuit 12 is configured to compensate for the pixel drive circuits 11 in the same row, thereby compensating for the random offset of each drive transistor with relatively high accuracy and arranging the pixel compensation circuits 12 in a simple manner. As shown in FIG. 10, the silicon-based display panel 100 includes the plurality of pixel compensation circuits 12 arranged in the same row, and the pixel drive circuits 11 in the same column correspond to the same pixel compensation circuit 12. In this manner, each pixel compensation circuit 12 is configured to compensate for the pixel drive circuits 11 in the same column, thereby compensating for the random offset of each drive transistor with relatively high accuracy and arranging the pixel compensation circuits 12 in a simple manner. As shown in FIG. 11, the silicon-based display panel 100 includes one pixel compensation circuit 12, and the plurality of pixel drive circuits 11 arranged in the array correspond to the same pixel compensation circuit 12. In this manner, the pixel compensation circuit 12 is configured to compensate for all the pixel drive circuits 11 in the entire silicon-based display panel 100 and arranged in a simple manner.

Further, with continued reference to FIGS. 8 to 11, the silicon-based display panel 100 may further include a display region AA and a non-display region NAA surrounding the display region AA, where the plurality of pixel drive circuits 11 are disposed in the display region AA. When each of the plurality of pixel compensation circuits 12 corresponds to a respective one of the plurality of pixel drive circuits 11, the plurality of pixel compensation circuits 12 are disposed in the display region, as shown in FIG. 8; or when the pixel drive circuits 11 in the same row correspond to the same pixel compensation circuit 12, the pixel drive circuits 11 in the same column correspond to the same pixel compensation circuit 12, or the plurality of pixel drive circuits 11 arranged in the array correspond to the same pixel compensation circuit 12, the at least one pixel compensation circuit is disposed in the non-display region, as shown in FIGS. 9, 10 and 11. The specific correspondence between the pixel drive circuits 11 and the at least one pixel compensation circuit 12 is not limited in the embodiment of the present disclosure and can be comprehensively considered according to the requirement on compensation accuracy and the difficulty in arranging the pixel compensation circuit 12, and the specific position of the pixel compensation circuit 12 is not limited.

Optionally, the silicon-based display panel provided by the embodiments of the present disclosure further includes a silicon substrate and an N-type potential well layer (not shown in the figures) disposed on one side of the silicon substrate. The N-type potential well layer in the embodiments of the present disclosure may be a deep N-type potential well layer. The deep N-type potential well layer includes a first surface facing towards the side of the silicon substrate and a second surface facing away from the side of the silicon substrate, the first surface has a first ion doping concentration N1, and the second surface has a second ion doping concentration N2, where $|N1-N2|/N1 \leq 10\%$. The plurality of pixel drive circuits are disposed in the deep N-type potential well layer.

Exemplarily, the drive transistor provided by the embodiments of the present disclosure may be an N-type metal-oxide-semiconductor (NMOS) transistor. In the related art, each NMOS transistor is disposed in an independent N-type potential well and a distance between adjacent two independent N-type potential wells is greater than 6 μm in an existing 0.11 μm CMOS process. Thus, a single pixel drive circuit occupies a very large area and cannot be applied to a high-resolution display apparatus. In the embodiments of the present disclosure, the plurality of pixel drive circuits in the entire silicon-based display panel are arranged in the same deep N-type potential well layer so that the area occupied by each pixel drive circuit can be greatly reduced, the integration degree of the pixel drive circuits in the entire silicon-based display panel can be improved, and the high-resolution silicon-based display panel can be achieved. Further, the deep N-type potential well layer provided by the embodiments of the present disclosure includes the first surface facing towards the side of the silicon substrate and the second surface facing away from the side of the silicon substrate (not shown in the figures), the first surface has the first ion doping concentration N1, and the second surface has the second ion doping concentration N2, where $|N1-N2|/N1 \leq 10\%$. Since the ion implantation of the deep N-type potential well layer is implemented from one surface of the potential well layer, the first ion doping concentration N1 of the first surface and the second ion doping concentration N2 of the second surface satisfy that $|N1-N2|/N1 \leq 10\%$, thereby ensuring the uniformity in the ion implantation concentration of the entire deep N-type potential well layer and a good isolation and protection effect on the drive transistor.

Based on the same inventive concept, the embodiments of the present disclosure further provide a display device including the silicon-based display panel according to any one of the embodiments of the present disclosure. The display device provided by the embodiments of the present disclosure may be an augmented reality (AR) display apparatus or a virtual reality (VR) display apparatus or another display device with a small size and a high integration degree. The type of the display device is not limited in the embodiments of the present disclosure.

It is to be noted that the above are merely preferred embodiments of the present disclosure and the principles used therein. It is understood by those skilled in the art that the present disclosure is not limited to the embodiments described herein and that the features in the various embodiments of the present disclosure may be coupled or combined in part or in whole with each other and may be collaborated with each other and technically driven in various manners. Those skilled in the art can make various apparent modifications, adaptations, combinations, and substitutions without departing from the scope of the present disclosure. Therefore, while the present disclosure has been described in detail through the above-mentioned embodiments, the present disclosure is not limited to the above-mentioned embodiments and may include more other equivalent embodiments without departing from the concept of the present disclosure. The scope of the present disclosure is determined by the scope of the appended claims.

What is claimed is:

1. A pixel circuit, comprising a pixel drive circuit and a pixel compensation circuit; wherein the pixel drive circuit comprises a drive transistor and an organic light-emitting element;

the drive transistor comprises an output terminal and a body terminal, wherein the output terminal is connected to an anode of the organic light-emitting element, and a cathode of the organic light-emitting element is connected to a cathode signal input terminal and configured to receive a cathode potential inputted from the cathode signal input terminal;

the body terminal is connected to the pixel compensation circuit at a first node, and a potential of the first node is a body potential; and the cathode potential $V_{com}$, a crossover voltage $V_{oled}$ of the organic light-emitting element, and the body potential $V_{body}$, satisfy that $V_{com}+V_{oled}>V_{body}$.

2. The pixel circuit according to claim 1, wherein the cathode potential is adjustable.

3. The pixel circuit according to claim 1, wherein the cathode potential is fixed.

4. The pixel circuit according to claim 2, wherein the pixel compensation circuit comprises an operational amplifier circuit, a first transistor, a first resistor, and a second resistor; wherein the second resistor has adjustable resistance;

the first transistor comprises an input terminal connected to a first voltage signal input terminal, an output terminal connected to a first terminal of the second resistor, and a control terminal connected to an output terminal of the operational amplifier circuit, the first resistor comprises a first terminal connected to a second terminal of the second resistor and a second terminal connected to a second voltage signal input terminal, and the operational amplifier circuit further comprises a forward input terminal connected to a second node and an inverse input terminal connected to the cathode signal input terminal, wherein the second node is disposed in series between the second resistor and the first resistor; and the first node is disposed in series between the first transistor and the second resistor.

5. The pixel circuit according to claim 4, wherein the pixel compensation circuit further comprises a voltage stabilizing capacitor;

wherein the voltage stabilizing capacitor comprises a first terminal connected to the first node and a second terminal grounded.

6. The pixel circuit according to claim 4, wherein the drive transistor further comprises an input terminal and a control terminal;

wherein the input terminal of the first transistor is disposed in a same layer as the input terminal of the drive transistor; the output terminal of the first transistor is disposed in a same layer as the output terminal of the drive transistor; and the control terminal of the first transistor is disposed in a same layer as the control terminal of the drive transistor.

7. The pixel circuit according to claim 1, wherein the cathode potential $V_{com}$, the crossover voltage $V_{oled}$ of the organic light-emitting element, the body potential $V_{body}$, and a breakdown voltage $V_{breakdown}$ of the drive transistor satisfy that $V_{com}+V_{oled}-V_{body}<V_{breakdown}$.

8. A silicon-based display panel, comprising a plurality of pixel circuits;

wherein the plurality of pixel circuits comprise a plurality of pixel drive circuits and pixel compensation circuits, and one of the plurality of pixel drive circuits corresponds to a respective one of the plurality of pixel circuits and one of the pixel compensation circuits corresponds to one or more pixel circuits;

each of the plurality of pixel drive circuits comprises a drive transistor and an organic light-emitting element, the drive transistor comprises an output terminal and a body terminal, wherein the output terminal is connected to an anode of the organic light-emitting element, and a cathode of the organic light-emitting element is connected to a cathode signal input terminal and configured to receive a cathode potential inputted from the cathode signal input terminal;

the body terminal is connected to the pixel compensation circuit at a first node, and a potential of the first node is a body potential; and the cathode potential $V_{com}$, a crossover voltage $V_{oled}$ of the organic light-emitting element, and the body potential $V_{body}$ satisfy that $V_{com}+V_{oled}>V_{body}$.

9. The silicon-based display panel according to claim 8, further comprising a silicon substrate and an N-type potential well layer disposed on one side of the silicon substrate, wherein the N-type potential well layer comprises a first surface facing towards the side of the silicon substrate and a second surface facing away from the side of the silicon substrate, the first surface has a first ion doping concentration N1, and the second surface has a second ion doping concentration N2, and $|N1-N2|/N1\leq 10\%$;

wherein the plurality of pixel drive circuits are disposed in the N-type potential well layer.

10. The silicon-based display panel according to claim 8, wherein the plurality of pixel drive circuits are arranged in an array; and the silicon-based display panel comprises a plurality of pixel compensation circuits arranged in an array, wherein each of the plurality of pixel compensation circuits corresponds to a respective one of the plurality of pixel drive circuits; or the silicon-based display panel comprises a plurality of pixel compensation circuits arranged in a same column, wherein pixel drive circuits in a same row correspond to a same pixel compensation circuit; or the silicon-based display panel comprises a plurality of pixel compensation circuits arranged in a same row, wherein pixel drive circuits in a same column correspond to a same pixel compensation circuit; or the silicon-based display panel comprises one pixel compensation circuit, wherein the plurality of pixel drive circuits arranged in the array correspond to the one pixel compensation circuit.

11. The silicon-based display panel according to claim 10, further comprising a display region and a non-display region surrounding the display region; wherein the plurality of pixel drive circuits are disposed in the display region;

when each of the plurality of pixel compensation circuits corresponds to a respective one of the plurality of pixel drive circuits, the plurality of pixel compensation circuits are disposed in the display region; or when the pixel drive circuits in the same row correspond to the same pixel compensation circuit, the pixel drive circuits in the same column correspond to the same pixel compensation circuit, or the plurality of pixel drive circuits arranged in the array correspond to the one pixel compensation circuit, the at least one pixel compensation circuit is disposed in the non-display region.

12. A display device, comprising a silicon-based display panel, wherein the silicon-based display panel comprises a plurality of pixel circuits;

wherein the plurality of pixel circuits comprise a plurality of pixel drive circuits and pixel compensation circuits, and one of the plurality of pixel drive circuits corresponds to a respective one of the plurality of pixel circuits and one of the pixel compensation circuits corresponds to one or more pixel circuits;

each of the plurality of pixel drive circuits comprises a drive transistor and an organic light-emitting element, the drive transistor comprises an output terminal and a body terminal, wherein the output terminal is connected to an anode of the organic light-emitting element, and a cathode of the organic light-emitting element is connected to a cathode signal input terminal and configured to receive a cathode potential inputted from the cathode signal input terminal;

the body terminal is connected to the pixel compensation circuit at a first node, and a potential of the first node is a body potential; and the cathode potential $V_{com}$, a crossover voltage $V_{oled}$ of the organic light-emitting element, and the body potential $V_{body}$ satisfy that $V_{com}+V_{oled}>V_{body}$.

* * * * *